US009266595B2

(12) United States Patent
Van Der Kam

(10) Patent No.: US 9,266,595 B2
(45) Date of Patent: Feb. 23, 2016

(54) RETRACTABLE THRUSTER UNIT FOR A MARINE VESSEL

(75) Inventor: Aad Van Der Kam, Drunen (NL)

(73) Assignee: Wärtsilä Finland Oy, Vassa (FI)

( * ) Notice: Subject to any disclaimer, the term of this patent is extended or adjusted under 35 U.S.C. 154(b) by 0 days.

(21) Appl. No.: 13/977,119

(22) PCT Filed: Dec. 13, 2011

(86) PCT No.: PCT/FI2011/051100

§ 371 (c)(1),
(2), (4) Date: Jun. 28, 2013

(87) PCT Pub. No.: WO2012/089914

PCT Pub. Date: Jul. 5, 2012

(65) Prior Publication Data

US 2013/0298816 A1 Nov. 14, 2013

(30) Foreign Application Priority Data

Dec. 30, 2010 (FI) ..... 20106382

(51) Int. Cl.

| | |
|---|---|
| ***B63H 5/125*** | (2006.01) |
| ***B63H 5/15*** | (2006.01) |
| ***B63H 25/42*** | (2006.01) |
| ***B63H 5/14*** | (2006.01) |

(52) U.S. Cl.

CPC ..... *B63H 25/42* (2013.01); *B63H 5/125* (2013.01); *B63H 5/14* (2013.01); *B63H 5/15* (2013.01); *B63H 2025/425* (2013.01)

(58) Field of Classification Search

CPC ..... B63H 5/14; B63H 5/15; B63H 5/20

USPC ..... 440/53–65, 66, 67, 70, 71, 72

See application file for complete search history.

(56) References Cited

U.S. PATENT DOCUMENTS

| | | | | |
|---|---|---|---|---|
| 3,550,547 | A | 12/1970 | Pleuger et al. | |
| 5,125,858 | A * | 6/1992 | Salvetti | B63H 5/125 440/49 |
| 5,435,762 | A * | 7/1995 | Reuter | B63H 5/125 440/54 |
| 5,522,335 | A * | 6/1996 | Veronesi et al. | 114/151 |
| 5,627,420 | A * | 5/1997 | Rinker et al. | 310/87 |

(Continued)

FOREIGN PATENT DOCUMENTS

| | | |
|---|---|---|
| FR | 1580093 A | 8/1969 |
| JP | 2000-272590 | 3/2000 |
| WO | 2010114380 A1 | 10/2010 |

OTHER PUBLICATIONS

International Search Report for corresponding PCT International Application No. PCT/FI2011/051100, completed on Feb. 24, 2012 and mailed on Mar. 5, 2012.

(Continued)

*Primary Examiner* — S. Joseph Morano
*Assistant Examiner* — Andrew Polay
(74) *Attorney, Agent, or Firm* — Heslin Rothenberg Farley & Mesiti P.C.; Victor A. Cardona, Esq.

(57) ABSTRACT

A novel retractable thruster unit for a marine vessel using a tunnel thruster includes a nozzle having an end, the end being provided with two closing plates, a top closing plate, and a bottom closing plate. The closing plates are arranged 180 degrees apart on opposite sides of the axis of the propeller and extend substantially axially from the end of the nozzle.

16 Claims, 3 Drawing Sheets

(56) References Cited

U.S. PATENT DOCUMENTS

| | | | |
|---|---|---|---|
| 7,641,526 | B1 | 1/2010 | Bekker |
| 2010/0175603 | A1 | 7/2010 | Jung |

OTHER PUBLICATIONS

Written Opinion of the International Searching Authority for corresponding PCT International Application No. PCT/FI2011/051100, completed on Feb. 24, 2012 and mailed on Mar. 5, 2012.

International Preliminary Report on Patentability for corresponding PCT International Application No. PCT/FI2011/051100, completed and mailed on Nov. 28, 2012.

Patent Search for priority application No. FI 20106382 dated Sep. 8, 2011.

Communication from the European Patent Office dated Jul. 3, 2015, concerning Application No. 11805069.9-1751.

* cited by examiner

RETRACTABLE THRUSTER UNIT FOR A MARINE VESSEL

CROSS-REFERENCE TO RELATED APPLICATIONS

This application is a 371 National Phase of International Application Number PCT/FI2011/051100 filed on Dec. 13, 2011, and published in English on Jul. 5, 2012 as International Publication Number WO 2012/089914 A1, which claims priority to Finnish Patent Application No. 20106382, filed on Dec. 30, 2010, the entire disclosures of which are incorporated herein by reference.

TECHNICAL FIELD

The present invention relates to a retractable thruster unit in accordance with the preamble of claim 1.

BACKGROUND ART

Marine vessels use various propulsion systems or units. The main propulsion unit or units is/are normally arranged in the aft part of the ship. The main propulsion unit may be either a fixed propeller arrangement creating a thrust force in the longitudinal direction of the marine vessel, or it may be a pod or a thruster, i.e. a propeller arrangement that may be rotated round a vertical axis.

The marine vessels have also other propulsion arrangements that are mainly used when manoeuvring a ship in a port, for instance. One type of such propulsion arrangements is a tunnel thruster, which may be used both at the bow and at the stern of a ship. The tunnel thruster is arranged in a horizontal tunnel running transverse to the longitudinal direction of the marine vessel through the hull of the marine vessel for assisting in moving the entire ship or one end of the ship sideways for instance for docking purposes.

The tunnel thrusters have been developed further by making such retractable i.e. the thruster unit may be kept within the hull but it may also be lowered below the hull i.e. below the baseline of the marine vessel. When the thrusters unit is in lowered position it may be rotated round a vertical axis, and it may thus be used to generate thrust in any desired direction for steering purposes.

As an example of a prior art retractable thruster U.S. Pat. No. 3,550,547 may be discussed. The document discloses an auxiliary maneuvering means for ships, which provide an improved maneuvering capability in deep water and which also are applicable when travelling in low waters, wherein a lateral thrust device is combined with a slewing propeller. The centre part of the tunnel of the lateral thrust device together with the propeller arranged therein is located in a recess in the interior of the ship. The centre part of the tunnel is constructed as nozzle, which is downwardly extendible and in the extended position turnable around 360°.

As another example of a prior art retractable thruster U.S. Pat. No. 5,522,335 may be discussed. The document discloses an auxiliary thruster for a marine vessel. The auxiliary thruster includes a submersible propulsion unit which has a shroud with a propeller rotatably mounted therein. A canned electric motor is mounted between the propeller and the shroud for rotating the propeller to create thrust. A propulsion unit deploying and rotating mechanism is mounted on the hull and on the propulsion unit. The propulsion unit deploying and rotating mechanism is operable to extend the propulsion unit out of the hull and retract it into the hull and to rotate the propulsion unit to direct the thrust generated thereby in any desired direction when the thruster is in the deployed position. When the thruster is retracted, it is positioned with a tunnel extending transversely through the hull. Rotation of the propeller while in the retracted position generates laterally directed thrust through the tunnel.

Both above discussed documents illustrate a retractable tunnel thruster where the thruster propeller is lowered with a part of the tunnel. In other words, with the propeller a lengthy conical or cylindrical tunnel part is moved below the keel of the marine vessel. The length of the tunnel part is of the order of the diameter of the propeller or even more, i.e. long enough to house the thruster entirely. When operating below the keel such a long tunnel part increases the flow resistance of the water 'pumped' through the tunnel part as well as outside the tunnel part. Also, the force needed to turn the thruster unit in its lowered position is relatively big, as the retractable tunnel part is long.

An object of the present invention is to optimize the structure of the retractable tunnel part for minimizing the flow resistance.

DISCLOSURE OF THE INVENTION

The above and other objects of the invention are met by a retractable thruster unit for a marine vessel having a tunnel thruster, the thruster unit comprising a propeller having a diameter and an axis and being surrounded by a retractable tunnel part, means for driving and steering the propeller and means for moving the propeller between its top and bottom positions, the retractable tunnel part having an inner diameter changing in the axial direction of the tunnel part, the retractable tunnel part being formed of a nozzle and two closing plates; a top closing plate, and a bottom closing plate, the closing plates being provided at one end of the nozzle and arranged 180 degrees apart on opposite sides of the axis of the propeller and extending substantially axially from the end of the nozzle.

Other characteristic features of the retractable thruster unit of the present invention will become apparent from the appended dependent claims.

The present invention, when solving at least one of the above-mentioned problems, also brings about a number of advantages, of which a few has been listed in the following:

- The retractable tunnel part, especially its nozzle, is shorter than the prior art structures
- With a shorter nozzle the retractable tunnel part may be modified to fully utilize an optimized nozzle profile (like for instance Rice Speed Nozzle or Kort Nozzle 19a), whereas a lengthy tunnel part of prior art has no real benefit in respect to thrust
- The moving mass is much lighter
- The projected outside area of the steering part is smaller, whereby the resistance and steering moment (force needed to turn the thruster unit in its lowered position) is also much less
- The retractable thruster units of the invention are especially beneficial in the wind turbine park projects However, it should be understood that the listed advantages are only optional, whereby it depends on the way the invention is put into practice if one or more of the advantages were obtained.

BRIEF DESCRIPTION OF DRAWING

In the following, the retractable thruster unit of the present invention is explained in more detail in reference to the accompanying Figures, of which

DETAILED DESCRIPTION OF DRAWING

Figures 1, 2:
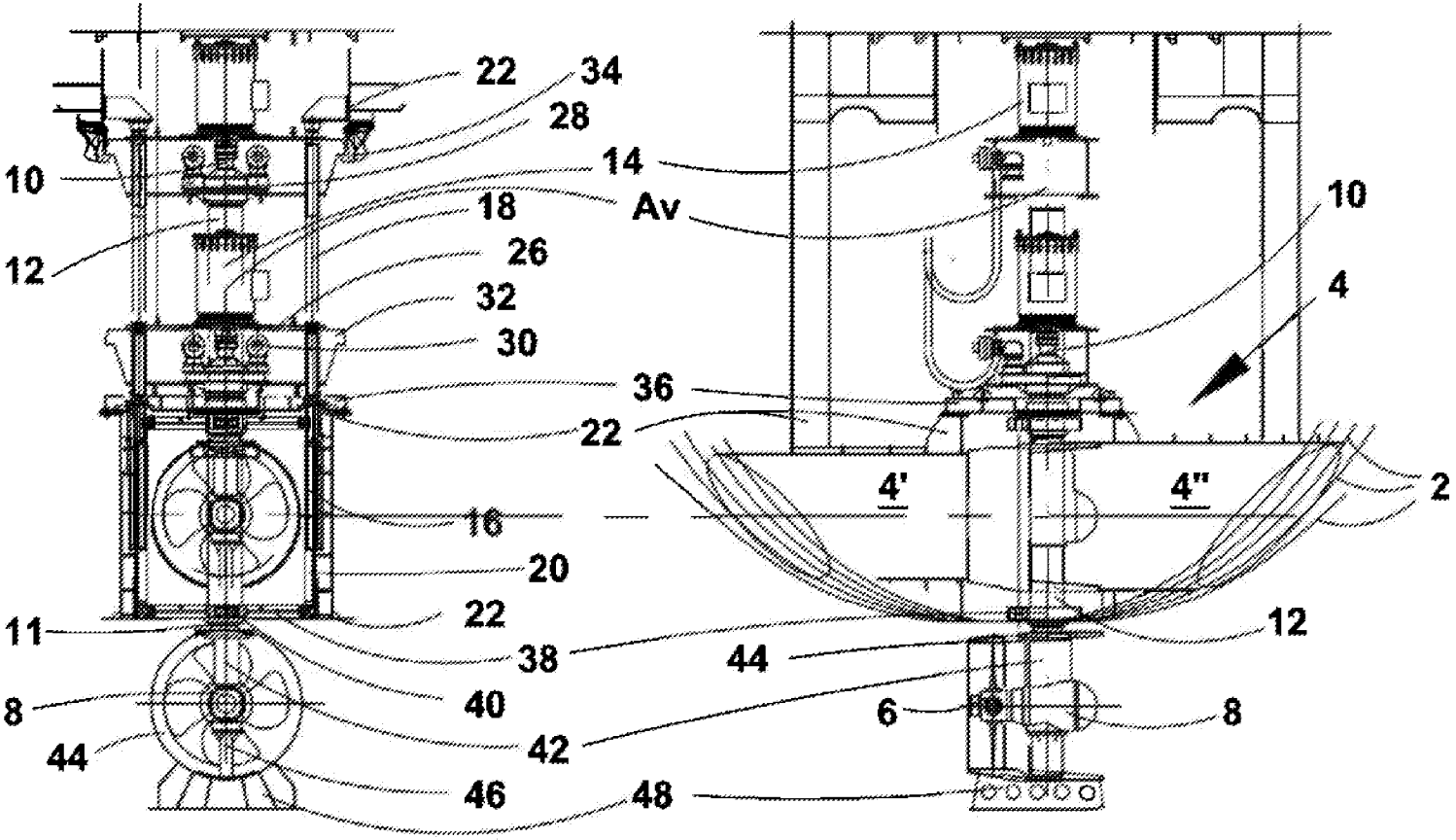
FIG. 1 illustrates a vertical cross-sectional view of a retractable thruster unit in accordance with a preferred embodiment of the present invention taken along a plane parallel with the longitudinal centerline of the marine vessel.
FIG. 2 illustrates a vertical cross-sectional view of a retractable thruster unit of FIG. 1 taken along a plane perpendicular to the longitudinal centerline of the marine vessel and running along the axis of the propeller tunnel.

In FIGS. 1 and 2 two vertical cross sectional views of a preferred embodiment of a retractable thrusters unit of the present invention are shown. Curved lines 2 represent the ship bottom at different longitudinal sections. The embodiment shows a tunnel thruster arranged at the bow of a marine vessel. However, tunnel thrusters may, in practice, be applied in any longitudinal position through the hull of a ship. Reference numerals 4' and 4" represent the two parts of a horizontal tunnel 4 arranged at right angles or transverse to the longitudinal centreline of the marine vessel. The left hand side tunnel 4', i.e. the tunnel part to the left from the propeller has a smaller diameter than the right hand side tunnel 4". The retractable thrusters unit is mainly formed of a thruster propeller 6, its right angle gear arranged within the thruster body 8 of the propeller 6, a drive shaft 10 surrounded by a support pipe 12, electric drive motor 14, which is, in this illustrated embodiment, arranged at the upper end of the drive shaft 10, means 16 for moving the thruster between its top and bottom positions and upper and lower guide arrangements 18 and 20 for supporting the retractable thrusters unit as it is moved in vertical direction. Already at this stage, it should, however, be understood that the drive shaft and the electric motor may be replaced with an electric or hydraulic drive unit arranged on the same axis with the thruster propeller 6 in connection with the thruster body 8. In such a case only necessary electric wiring or hydraulic tubing need to be brought down to the thruster body 8. The Figures illustrate the retractable thrusters unit in its both positions i.e. in its top and bottom positions.

The retractable thruster unit is fastened to the supporting hull structures (these cover all beams, walls, decks, reinforcements, etc. arranged in the hull of a marine vessel) shown generally by reference numeral 22 by means of two different guide arrangements 18 and 20. The upper guide arrangement is a pair of guide columns 18 running vertically above the tunnel level between two supporting hull structures 22. The two guide columns 18 are fastened to the supporting hull structures, and arranged in the same vertical plane with the vertical axis Av of the thruster unit. The lower arrangement is a pair of guide frames 20 running vertically at the sides of the tunnel (in fact at the sides of the retractable tunnel part) and fastened to the supporting hull structures 22 at both of their ends.

The guide columns 18 support a motor support frame 26, which is arranged to be moved vertically along the guide columns 18. The electric drive motor 14 is fastened to the motor support frame 26 as well as a rotation gear 28 provided with steering motors 30 with which the direction of the thruster propeller 6 may be changed when the propeller is lowered to its bottom position. However, the rotation gear 28 may be arranged in a frame of its own (especially when the drive of the propeller is not arranged by means of an electric motor arranged outside the tunnel) so that the frame is in itself supported to the guide columns 18. Also, it is possible that the rotation gear frame is fastened to the motor support frame 26.

In the following, the construction of the vertical drive and steering means are explained in more detail. The vertical drive shaft 10 of the propeller 6 is coupled at its upper end to the electric motor 14 and extends down to the right angle gear in the thruster body 8. The drive shaft 10 is surrounded by a rotary pipe 11 that is coupled at its upper end to a rotary member of the rotation gear 28 and at its lower end to the thruster body 8. The rotary pipe 11 is surrounded by and supported by bearings to a non-rotary support pipe 12 that is fastened at its upper end to the motor support frame 26 or to a non-rotary part of the rotation gear 28 and at its lower end to a thrust beam 38 (discussed later on in more detail). The motor support frame 26 is also provided with hook-shaped members 32 that co-operate with movable safety hooks 34 fastened to the supporting hull structures 22 for locking the thruster unit in its top position.

The lower ends of the guide columns 18 are fastened to a foundation plate 36 which is again fastened to the supporting hull structures 22. The foundation plate 36 is arranged slightly above the tunnel 4. The foundation plate 36 is also provided with a watertight gland cooperating with the non-rotary support pipe 12 for preventing the sea water from entering the cavity where the electric motor is positioned. To the same foundation plate 36 are also fastened the guide frames 20 at their upper ends. The lower ends of the guide frames 20 are attached to the supporting hull structures 22 at the bottom of the marine vessel.

Thus, the vertical movement of the thruster 6 unit of a preferred embodiment of the present invention is, on the one hand, supported by the motor frame 32 to the guide columns 18, and, on the other hand, by the horizontal thrust beam 38 to the guide frames 20. The thrust beam 38 is running transverse to the tunnel 4', 4" direction just above a retractable tunnel part (discussed later on in more detail) so that the ends of the beam are arranged in V-shaped grooves (discussed in more detail later on) provided in vertical underwater guide frames 20. The thrust beam 38 is fastened (shown in more detail in FIG. 5) at its centre to the support pipe 12 surrounding the rotary pipe 11 and the drive shaft 10 of the thruster propeller 6. Thus the support pipe 12 connects the motor frame 26 and the thrust beam 38 to a vertically movable drive shaft support unit. The retractable thrusters unit is moved up and down by means of a pair of hydraulic cylinders 16 that are arranged in connection with guide tubes at both sides of the retractable tunnel part. The cylinders 16 are fastened to the foundation plate 36 and their pistons move the motor frame 26 between its top and bottom positions. However, it should be understood that the cylinders may as well be installed above the foundation plate 36, or, for instance, replaced with other means for moving the motor frame.

The lower part of the retractable thruster unit is constructed around the thruster propeller 6 and its body 8. The body 8 is supported either directly to the lower end of the rotary pipe 11 or to an upper support arm 42 fastened to the lower end of the rotary pipe 11. In the illustrated embodiment the lower end of the rotary pipe 11 extends from the lower end of the support pipe 12 below the thrust beam 38 such that the upper support arm 42 may be fastened thereto. The propeller is surrounded by a nozzle shaped circular part 44 (called as nozzle 44 from now on) of the retractable tunnel part. The nozzle has a larger inlet opening and a smaller outlet opening (flow from the right to the left in FIG. 2) when the propeller is in its bottom position. It should be understood that when the propeller 6 is used within the tunnel 4 the propeller 6 may be rotated in both directions whereby the thrust may be affected in both directions. The inner diameters of the axially outer rims or ends of the nozzle 44 correspond substantially to those of the tunnel parts 4' and 4". The nozzle 44 may be fastened directly to the upper support arm 42 above the thruster body 8, and to a lower support arm 46 below the thruster body 8. The support arms 42 and 46 are arranged on opposite sides of the thruster body 8, i.e. 180 degrees apart. Below the retractable tunnel part and the support arm 46 there is a well closing structure 48 the purpose of which is to close the opening or well at the bottom of the marine vessel when the thruster is moved to its upper position. The well closing structure 48 is fastened to the lower support arm 46, and moves therewith in vertical direction. The well closing structure 48 may also be fastened to the nozzle 44, which, on its part, may be fastened to both the lower support arm 46 and to the well closing structure 48 or to the well closing structure 48 only.

To improve the hydrodynamic properties of the tunnel thruster and especially those of the lowered thruster the retractable tunnel part i.e. the part of the tunnel 4 that is lowered with the thruster propeller 6 below the keel of the marine vessel, and especially its nozzle 44 is made clearly shorter than in prior art structures. In accordance with the performed experiments the hydrodynamic properties of the nozzle 44 are best when the length of the nozzle is less than 0.7 times the diameter of the propeller diameter, preferably about one half of the propeller diameter (for instance Rice Speed Nozzle or Kort nozzle 19a). However, all prior art retractable thrusters have had a full-length retractable tunnel part meaning a tunnel extending from upstream of the propeller up to the trailing end of the thruster body and its support structures, which ends up to a length corresponding to at least the propeller diameter. Such a lengthy tunnel part adds both to flow resistance decreasing the efficiency of the propeller and turning moment and the weight of the retractable thruster unit.

Figure 3:
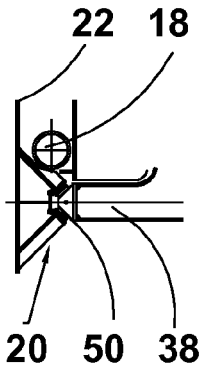
FIG. 3 illustrates a horizontal partial cross sectional view of the retractable thruster unit of FIG. 1 showing in more detail the structure of the lower guide arrangement.
Figure 4:
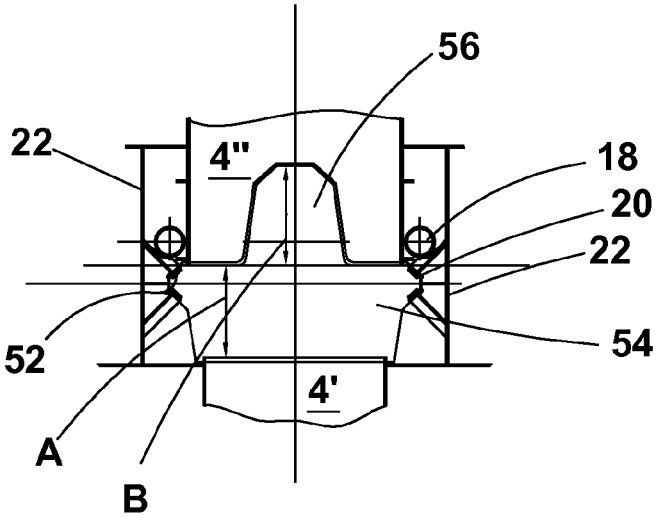
FIG. 4 illustrates a horizontal cross sectional bottom view of the propeller tunnel along the tunnel axis, the thruster unit being removed from the tunnel.

FIG. 3 is a partial horizontal cross sectional view of a preferred embodiment of the retractable thruster unit of the present invention showing a more detailed structure of the lower guide arrangement 20 together with the thrust beam 38. FIG. 4 is a partial horizontal cross sectional view of a preferred embodiment of the retractable thruster unit of the present invention taken along the axis of the tunnel 4', 4" seen from below. The Figures show the mutual positioning of the upper and lower guide arrangements 18 and 20 that are fastened to the supporting hull structures 22. The upper guide arrangements 18 are preferably, but not necessarily, aligned with the vertical drive shaft and the support pipe, whereas the lower guide arrangements 20 are placed at a certain offset in relation thereto, i.e. closer to the propeller. In this way, the nozzle 44 (shown in FIG. 2) of the retractable tunnel part may be made shorter and still be supported by the guide arrangements 20 at both sides of the nozzle. Naturally, the lower guide arrangements could be positioned farther away from the propeller, but such would require specific support arrangements like horizontally extending beams etc. for supporting a short nozzle. In other words the guides 18 and 20 are not aligned but there is, preferably, a certain offset in the longitudinal direction of the tunnel between the two guide arrangements 18 and 20. Figures also show the more detailed construction of the lower guide arrangement i.e. that of the guide frame 20. In other words, both guide frames 20 form a V-shaped groove provided with guide strips 52 that run from the top of the guide frame 20 to the bottom thereof. The ends of the thrust beam 38 are provided with thrust pads 50 being either in sliding communication with the guide strips 52 or arranged at a small clearance (preferably of the order of less than 5 mm) depending on the position of the propeller (if in top position the clearance may be bigger, when in lowered position the clearance should be minimized). In other words, when the propeller 6 is in its lowered or bottom position the thrust pads 50 and strips 52 carry the thrust force the propeller has created to the hull of the marine vessel.

FIG. 4 also shows the opening or cutout left in the tunnel 4', 4" when the propeller with its retractable tunnel part is lowered. The cutout is formed of a circumferential cutout portion 54 covering the entire tunnel circumference, having an axial dimension A and corresponding substantially to the nozzle of the retractable tunnel portion and upper and lower cutout portions. The upper cutout portion has an axial dimension B, and is shown by a reference numeral 56. The lower cutout portion is shown with reference numeral 57 in FIG. 5. The upper cutout portion 56 is located in the middle of the top wall of the tunnel, and the lower cutout portion 57 directly below that in the bottom wall of the tunnel. The circumferential cutout portion 54 is the part of the tunnel that is filled with the nozzle 44 of the retractable tunnel part (shown in FIG. 2) when the thrusters is in its top position. The upper and lower cutout portions 56, 57, which in a preferred embodiment of the invention are located at the tunnel part 4", are needed for allowing part of the thrust beam 38 and/or the thruster body 8 (shown in more detail in FIG. 5) to pass therethrough when the thruster unit is retracted. The thrust beam 38 extends transversely across the tunnel within the axial dimension A of the circumferential cutout portion 54.

Figure 5:
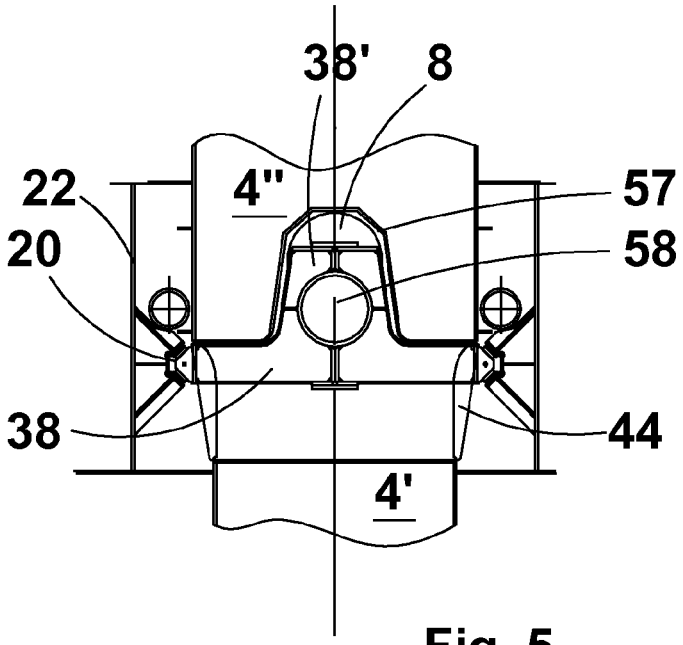
FIG. 5 illustrates a horizontal cross sectional top view of the propeller tunnel along the tunnel axis, the retractable thruster unit being lowered in its bottom position.

FIG. 5 shows a partial horizontal cross sectional top view of a preferred embodiment of the retractable thruster unit of the present invention taken along the axis of the tunnel 4', 4" when the thrusters is lowered. The Figure shows like FIGS. 3 and 4, too, how the ends of the thrust beam 38 are arranged in the V-shaped guide frames 20, and further how the thrust beam 38 has an extension 38' in the longitudinal direction of the tunnel 4', 4". The extension 38' of the thrust beam 38 has an opening 58 for receiving the support pipe surrounding the rotary pipe and the drive shaft of the propeller. Neither the thrust beam 38 nor its extension 38' extend in any direction outside the area that is covered by the tunnel cutout portions 54, 56 and 57 (shown in FIG. 4).

Now, referring to both FIG. 4 and FIG. 5 the shape and size of the upper and lower cutout portions, 56 and 57, respectively, will be discussed in more detail. The upper and lower cutout portions 56, 57 in the tunnel part 4" are needed as the thruster body 8, and the support pipe for the drive shaft of the thruster, together with the axial extension 38' of the thrust beam 38 having the opening 58 for the support pipe, have to be moved between their top and bottom positions. In normal operating conditions, it is the thrust beam extension 38', only, that has to pass the top wall of the tunnel 4", and both the thruster body 8 and the extension 38' that have to pass the bottom wall of the tunnel 4". Therefore, it is the horizontal projection of the extension 38' that dictates the size and shape of the upper cutout portion 56, and the combined horizontal projection of the thruster body 8 (which is in axial direction longer than the extension 38' of the thrust beam in the illustrated example) and the thrust beam extension 38' that dictate the size and shape of the lower cutout portion 57. The upper cutout portion 56 is, preferably but not necessarily, as small as possible. The prerequisite for the dimensioning of the upper cutout 56 is to allow the thrust beam extension 38', and also the thruster body 8 (in case, for instance for maintenance reasons, it should be removed upwardly) that extends beyond the horizontal projection of the extension 38', be moved in vertical direction past the top wall of the tunnel 4. The lower cutout portion 57 is also, preferably but not necessarily, as small as possible. The prerequisite for the dimensioning of the lower cutout 57 is that in all occasions both the thrust beam extension 38', and the thruster body 8 that extends beyond the horizontal projection of the extension 38', may be moved, with proper running clearance, vertically past the bottom wall of the tunnel. Preferably the thrust beam extension 38' does not extend longitudinally beyond the thruster body 8 below it, as shown in the FIG. 5. In transverse direction the thrust beam extension 38' is only as wide as required by its structural strength. However, it may be wider than the thruster body 8 below it. In any case, it means that the thrust beam extension 38' may increase the size of the tunnel cutout portions 56 and 57, in addition to the thruster body 8. Normally, the cutout portion 56 may be sized based on the thrust beam extension 38' only, since the thruster body 8 does not in any normal operating position pass the upper cutout portion 56. Yet, since the difference in the size of the cutout portions 56 and 57 is not big, it is advantageous to provide both the upper and lower tunnel 4" walls with similarly dimensioned cutout portions 56 and 57. However, also for maintenance and installation reasons it is advantageous to be able to install the thruster unit from above in the thruster well, whereby the thruster body 8 has to pass the upper cutout portion, too. In that case it is necessary to have similarly shaped cutout portions 56, 57 in both top and bottom wall of the tunnel part 4".

Additionally, FIG. 5 shows the nozzle 44 having a substantially short axial extension (comparable to dimension A in FIG. 4), compared with the length of the whole thruster (comparable to dimension A+B in FIG. 4).

Figure 6:
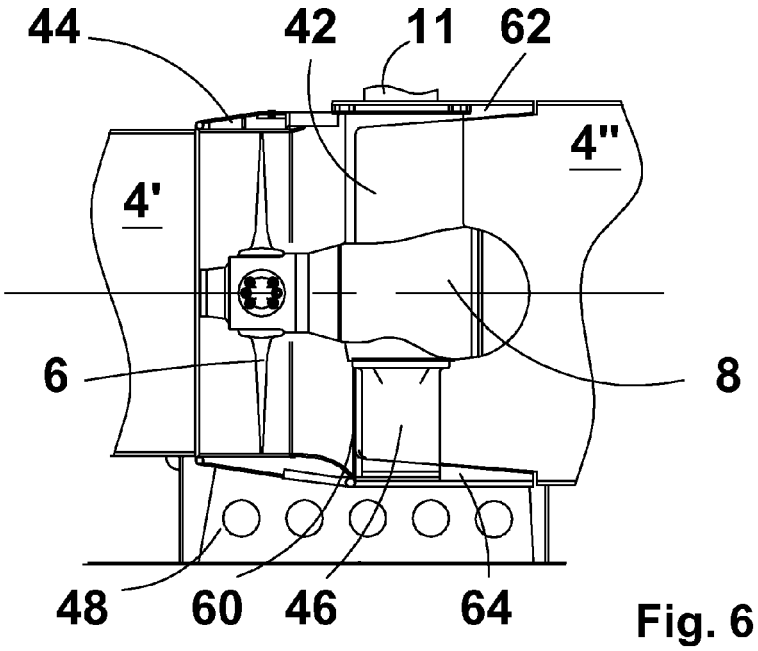
FIG. 6 illustrates an enlarged cross sectional side view of the retractable thruster unit of the invention taken along the tunnel axis.

FIG. 6 illustrates an enlarged vertical cross sectional view of a preferred embodiment of the retractable thruster unit of the present invention taken along the axis of the tunnel 4 when the retractable thruster unit is in its top position. Between the tunnel parts 4' and 4" there is the retractable tunnel part, formed mainly of the nozzle 44. The nozzle 44 is, in this embodiment, at its upper part fastened to the upper end of the upper support arm 42 and at its lower part to the well closing structure 48 and/or to the lower support arm 46. Reference numeral 60 represents the right hand side end of the nozzle 44, which faces the larger tunnel part 4". The cutout portions in the top and bottom walls of the tunnel part 4" are closed by top and bottom closing plates 62 and 64, respectively. Thus the retractable tunnel part is formed of the nozzle 44 and the closing plates 62 and 64. Both closing plates 62 and 64 are curved plates whose inner diameter corresponds to that of the tunnel part 4" and shape to that of the cutout portions 56 and 57 (FIGS. 4 and 5) in the tunnel part 4". The closing plates 62 and 64 extend in the direction of the tunnel part 4" whereby their direction is normally axial i.e. parallel to the axis of the tunnel, unless the tunnel part 4" is slightly conical whereby the direction of the closing plates may be considered to be substantially axial. The bottom closing plate 64 is preferably fastened between the upper surface of the well closing structure 48 and the lower end of the lower support arm 46. Naturally it is also possible to fasten the bottom closing plate 64 onto the well closing structure 48 such that the bottom closing plate 64 has a hole for the lower support arm 46, whereby the well closing structure 48 may be fastened directly to the lower support arm 46. Also other fastening arrangements may be applied. The top closing plate 62 is, in accordance with the embodiment illustrated in FIG. 6 fastened between the lower end of the rotary pipe 11 and the upper end of the upper support arm 42. Thus the upper and lower closing plates 62 and 64 are arranged as axial extensions of the end 60 of the nozzle 44 such that they are 180 degrees apart, i.e. on opposite sides of the axis of the nozzle 44 and that of the retractable tunnel part. The closing plates 62 and 64 cover together less than a half of the perimeter of the retractable tunnel part, preferably less than one fourth thereof. In practice the closing plates 62 and 64 may be fastened, for instance welded, to the end 60 of the nozzle 44 so that the retractable tunnel part is by means of the closing plates 62 and 64 fastened to the upper and lower support arms 42 and 46. However, it is also possible that the closing plates 62 and 64 are separate sheet metal members that are independently fastened to the support arms 42 and 46, whereby the nozzle 44 is fastened separately to the support arms, either directly or by means of intermediate fastening means like for instance the well closing structure 48. In case the rotary pipe 11 extends down to the thruster body, i.e. without an upper support arm therebetween, it is clear that the retractable tunnel part is fastened to the rotary pipe 11.

Figure 7:
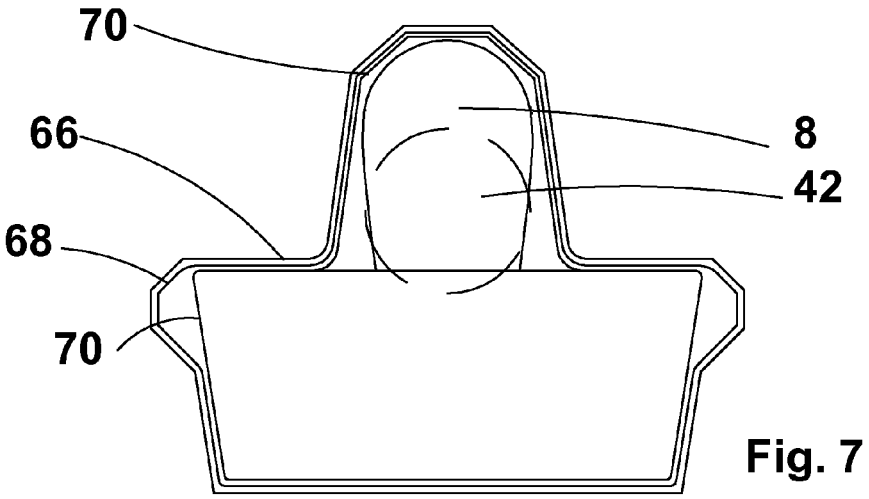
FIG. 7 illustrates a schematic bottom view exemplifying the shapes of some cutouts and that of the well closing structure.

FIG. 7 clarifies the shapes of various cutouts and closing plates needed in various structures for allowing the vertical movement of the thruster unit between its top and bottom positions. The outermost cutout 66 represents the opening or well needed necessarily in the bottom of the marine vessel for allowing the thruster unit to be lowered below the keel. As can be seen the cutout 66 has to allow not only the passage of the nozzle and the thruster body 8, but also that of the guide frames as the frames extend close to the bottom, i.e. the base line of the marine vessel in order to give the best possible support for the thruster when it is lowered to its bottom position. By reference numeral 68 the perimeter of the well closing structure is shown. Naturally, the shape of the well closing structure is the same as that of the cutout 66 with a small running clearance. However, the opening in the bottom steel plate of the ship could be designed more freely. In fact, it just has to be wide enough to allow the thruster unit to pass therethrough. Thus also the closing structure could be designed more freely to conform to the shapes of the opening. And finally, by reference numeral 70 the cutout in the tunnel has been shown. In other words, the cutout 70 is needed for allowing the vertical movement of the nozzle and the thruster body 8. This Figure may also be considered to reveal the shape of the top and bottom closing plates 62 and 64 (FIG. 6), as the closing plates resemble the part of the cutout 70 above the truncated cone-section of the cutout, i.e. corresponds to cutout portions 56, 57 in FIG. 5.

It should be understood that the above is only an exemplary description of a novel and inventive retractable thruster unit. It should be understood that though the specification above discusses a certain type of a retractable thruster unit, the type of the retractable thruster unit does not limit the invention to the types discussed. Thus it is clear that the drive of the propeller may be arranged by means of an electric or a hydraulic motor arranged down in the thrusters body. Also, it is clear that the shape of the tunnel parts 4' and 4" does not limit the invention, whereby the tunnel parts may be either cylindrical or conical. The above explanation should not be understood as limiting the invention by any means but the entire scope of the invention is defined by the appended claims only. From the above description it should be understood that separate features of the invention may be used in connection with other separate features even if such a combination has not been specifically shown in the description or in the drawings.

The invention claimed is:

1. A retractable thruster unit for a marine vessel having a tunnel thruster, the thruster unit comprising:

a propeller having a diameter and an axis and being surrounded by a retractable tunnel part, means for driving and steering the propeller and means for moving the propeller between its top and bottom positions, the retractable tunnel part having an inner diameter changing in the axial direction of the tunnel part, wherein the retractable tunnel part is formed of a nozzle and two tunnel closing plates, a top closing plate, and a bottom closing plate, the closing plates being provided at one end of the nozzle and—arranged 180 degrees apart on opposite sides of the axis of the propeller, extending substantially axially from the end of the nozzle and covering together less than a half of a perimeter of the retractable tunnel part.

2. The retractable thruster unit as recited in claim 1, wherein the nozzle has an axial length less than 0.7 times the propeller diameter.

3. The retractable thruster unit as recited in claim 1, wherein the driving and steering means comprises a rotation gear supported by the means for moving the propeller, and a rotary pipe connected at an upper end thereof to a rotary part of the rotation gear, the rotary pipe carrying at its lower end both the retractable tunnel part and the propeller.

4. The retractable thruster unit as recited in claim 1, wherein the driving and steering means comprises a thruster propeller body and the propeller, the retractable tunnel part being attached to the thruster propeller body by means of upper and lower support arms.

5. The retractable thruster unit as recited in claim 3, wherein the upper support arm is a part of the rotary pipe or a member attached thereto.

6. The retractable thruster unit as recited in claim 5, wherein the top closing plate is attached to the upper support arm and the bottom closing plate to the lower support arm.

7. The retractable thruster unit as recited in claim 5, wherein the top closing plate is fastened between the rotary pipe and the upper support arm.

8. The retractable thruster unit as recited in claim 4, wherein at least one of the closing plates is fastened to the nozzle and the nozzle is by means of said at least one closing plate fastened to a respective upper and/or lower support arm.

9. The retractable thruster unit as recited in claim 3, wherein the means for moving the propeller comprises an upper guide arrangement and a lower guide arrangement, the upper guide arrangement supporting the rotation gear and the lower guide arrangement supporting by means of a thrust beam a non-rotary support pipe, the non-rotary support pipe connecting the rotation gear and the thrust beam, the rotary pipe being supported within the non-rotary support pipe.

10. The retractable thruster unit as recited in claim 9, wherein the lower guide arrangement is formed of two guide frames arranged at both sides of the nozzle and fastened to the supporting hull structures, the guide frames being offset from a plane running along a vertical axis of the thruster unit.

11. The retractable thruster unit as recited in claim 9, wherein the upper guide arrangement is formed of two guide columns arranged above a tunnel level, fastened to the supporting hull structures, and arranged in the same vertical plane with a vertical axis of the thruster unit.

12. The retractable thruster unit as recited in claim 10, wherein a foundation plate fastened to supporting hull structures has been arranged above the tunnel level, the lower ends of the guide columns and the upper ends of the guide frames being fastened to the foundation plate.

13. The retractable thruster unit as recited in claim 1, wherein the nozzle has an axial length less than 0.5 times the propeller diameter.

14. The retractable thruster unit as recited in claim 1, wherein the upper and lower closing plates cover together less than one fourth of a perimeter of the retractable tunnel part.

15. A retractable thruster unit for a marine vessel having a tunnel thruster, the thruster unit comprising:

a propeller having a diameter and an axis and being surrounded by a retractable tunnel part, means for driving and steering the propeller and means for moving the propeller between its top and bottom positions, the means for steering the propeller comprising a rotary pipe coupled at an upper end thereof to a rotation gear and at its lower end to a propeller thruster body, the propeller being arranged in connection with the thruster body, the rotary pipe being surrounded and supported by bearings to a non-rotary support pipe, the non-rotary support pipe being fastened at a lower end thereof to a thrust beam by a thrust beam extension extending in a longitudinal direction of the tunnel part, the retractable tunnel part having an inner diameter changing in the axial direction of the tunnel part, wherein the retractable tunnel part is formed of a nozzle and two tunnel closing plates, a top closing plate, and a bottom closing plate, the closing plates being provided at one end of the nozzle and arranged 180 degrees apart on opposite sides of the axis of the propeller, extending substantially axially from the end of the nozzle and covering together less than a half of a perimeter of the retractable tunnel part, at least one of the closing plates having a shape corresponding to a combined horizontal projection of the thruster body and the thrust beam extension.

16. The retractable thruster unit as recited in claim 15, wherein the nozzle has an axial length less than 0.7 times the propeller diameter.

* * * * *